United States Patent [19]

Ghosh et al.

[11] Patent Number: 4,770,848

[45] Date of Patent: Sep. 13, 1988

[54] GRAIN REFINEMENT AND SUPERPLASTIC FORMING OF AN ALUMINUM BASE ALLOY

[75] Inventors: Amit K. Ghosh; Chimata Gandhi, both of Thousand Oaks, Calif.

[73] Assignee: Rockwell International Corporation, El Segundo, Calif.

[21] Appl. No.: 85,690

[22] Filed: Aug. 17, 1987

[51] Int. Cl.[4] ..... B22F 3/14

[52] U.S. Cl. ..... 419/28; 148/11.5 A; 148/11.5 P; 148/12.7 A; 148/417; 419/29; 419/48; 419/54; 420/902

[58] Field of Search ..... 148/11.5 A, 11.5 P, 148/12.7 A, 417, 439; 419/28, 29, 48, 54; 420/532, 902

[56] References Cited

U.S. PATENT DOCUMENTS

| | | | |
|---|---|---|---|
| 3,544,394 | 12/1970 | Lyle, Jr. et al. | 148/12.7 A |
| 3,563,814 | 2/1971 | Lyle, Jr. et al. | 148/417 |
| 3,997,369 | 12/1976 | Grimes et al. | 148/11.5 A |
| 4,092,181 | 5/1987 | Paton et al. | 148/12.7 A |
| 4,435,213 | 3/1984 | Hildeman et al. | 148/11.5 P |
| 4,462,843 | 7/1984 | Baba et al. | 148/11.5 A |
| 4,486,244 | 12/1984 | Ward et al. | 420/902 |
| 4,582,544 | 4/1986 | Grimes et al. | 148/11.5 A |
| 4,722,754 | 2/1988 | Ghosh et al. | 148/11.5 A |

FOREIGN PATENT DOCUMENTS

| | | | |
|---|---|---|---|
| 86248 | 5/1985 | Japan | 420/902 |
| 86249 | 5/1985 | Japan | 420/902 |
| 1387586 | 3/1975 | United Kingdom . | |
| 1445181 | 8/1976 | United Kingdom . | |

OTHER PUBLICATIONS

Watts, et al., Superplasticity in Al-Cu-Zr Alloys Parts I and II, Jun. 1976, pp. 189-206.

J. A. Wert, Ultrafine Grain Aluminum Research and Data, Interim Report No. 4, Oct. 1985, pp. 1-8.

*Primary Examiner*—L. Dewayne Rutledge

*Assistant Examiner*—Robert L. McDowell

*Attorney, Agent, or Firm*—H. Fredrick Hamann; Craig O. Malin

[57] ABSTRACT

A rapidly-solidified aluminum alloy powder having a nominal composition of 7% Zn, 2.5% Mg, 2% Cu, 0.3% Zr, and 0.3% Cr is used to make a high forming-rate, superplastic, high-strength aluminum alloy. The powder is outgassed, consolidated, and extruded, thereby developing a wide range of particle size distribution of dispersoids in the process, containing respectively zirconium and chromium dispersoids, as well as age hardening precipitates. The consolidated powder is then rolled to 85% reduction to provide a sheet material which is superplastically formed at a temperature in the range of 450° C. to 490° C. and at a rate between $5\times10^{-3}$ to $5\times10^{-2}$ per second.

5 Claims, 2 Drawing Sheets

GRAIN REFINEMENT AND SUPERPLASTIC FORMING OF AN ALUMINUM BASE ALLOY

STATEMENT OF GOVERNMENT INTEREST

The Government has rights in this invention pursuant to Contract No. F33615-83-C-5118 awarded by the Air Force.

BACKGROUND OF THE INVENTION

This invention relates to the field of superplastic alloys, and particularly to a method of thermomechanical processing and superplastic forming a high-strength aluminum alloy at a higher strain rate.

Aluminum alloys containing Zn, Mg, Cu, and other elements in small quantities are highly desirable for aircraft structures because they can be heat treated to high strength (yield strength of approximately 70 KSI). These high strength alloys, as conventionally processed from cast ingots, have very large grains and they cannot be superplastically formed.

U.S. Pat. No. 4,092,181 describes a process for fabricating high strength alloys (e.g., 7075 and 7475) with a fine grain size of approximately 10 μm. This four-step process utilizes static recrystallization to obtain a stable, fine-grain size prior to superplastic forming. The alloy is solution treated and overaged, and then rolled to impart high local plastic strains around the coarse, aged precipitates. During a subsequent step of static annealing, new grains are nucleated around these precipitates. However, not all of the aged particles are successful in nucleating a grain. This is due to the nonuniformity of plastic strain in the alloy matrix in the vicinity of different particles which causes high energy grain boundaries to consume lower energy grain boundaries during recrystallization. To achieve a finer grain size in such alloys, it was realized that a more uniform intense strain energy distribution in the matrix is needed.

Fine grain, high strength aluminum alloys processed according to the prior art patent can be superplastically formed into complex geometrical shapes. However, the forming rate for these alloys is rather low (approximately $2\times10^{-4}s^{-1}$), requiring 70–100 minutes to form a typical part. Thus a strong need existed for achieving a finer grain alloy capable of much higher forming rates.

British Pat. Nos. 1,387,586 and 1,445,181 describe aluminum alloys which provide higher strain rates ($5\times10^{-3}s^{-1}$), but their yield strength is lower than that of the alloys described in the U.S. patent. The low-strength alloys contain Zr, Nb, and Ti as grain-refining agents, and they recrystallize during superplastic forming rather than during heat treatment prior to forming as described for the high-strength alloys. According to the British patents, a large amount of Zr in supersaturated solid solution is a prerequisite during casting of the alloy. During superplastic forming, the Zr precipitates develop from the supersaturated solid solution and the alloy recrystallizes to provide a grain size below 15 μm. To take advantage of recrystallization during forming, the forming is done during a rapidly rising temperature, resulting in superplastic elongations of 400 to 600%.

There are many applications for the above described superplastic aluminum alloys. However, there are many structural applications which require significantly higher strength levels than these alloys or 7075 and 7475 aluminum can provide. Currently there are no high strength aluminum alloys of this type which can also be superplastically formed at a reasonably rapid forming rate. The combination of strength and forming strain rate provided by the prior art superplastic aluminum alloys is not adequate for many of the future applications.

SUMMARY OF THE INVENTION

It is an object of this invention to provide a method for grain refinement of a high strength precipitation hardenable aluminum alloy.

It is an object of the invention to provide a method for superplastically forming a high-strength aluminum alloy.

It is an object of the invention to provide a superplastic aluminum alloy and to form it at a high strain rate.

It is an object of the invention to provide a method for superplastically forming a high-strength aluminum alloy at a high forming rate.

According to the invention, aluminum alloy powder rather than a cast ingot is used to fabricate the alloy. The alloy has a nominal composition of 7% Zn, 2.5% Mg, 2% Cu, 0.3% Zr, and 0.3% Cr. This composition provides a heat-treatable alloy with a strength that is somewhat higher than the 7000 series aluminum alloys. The individual powder particles are formed by inert gas atomization (rapid solidification) from melt which subsequently leads to uniform distribution of the dispersoids formed by the relatively large amount of Zr and Cr in the alloy.

A compact of the powder is hot outgassed with inert gas flushing and hot consolidated, and further extruded at 380° to 400° C. to a reduction of at least 4:1 to break up and disperse oxides and achieve complete consolidation. These powder metallurgy processing steps (constituting 10 hours or more at 380°–400° C.) precipitate substantially all the Cr- and Zr-containing dispersoids as well as Cu-and Mg-rich aging precipitates, thus providing a rather wide particle size distribution comprising of (i) very small Zr precipitates, (ii) larger Cr precipitates, and (iii) very large overaged Cu- and Mg-rich precipitates.

Typically precipitation hardenable aluminum alloy billets are given an overaging treatment prior to rolling. However, because of the above powder processing steps, and the presence of a preferred distribution of precipitates in the as-extruded material, additional heat treating to overage the aluminum alloy is not required, and should be avoided.

The extruded aluminum alloy is then rolled into sheet by reducing its thickness approximately 85%. This is accomplished by heating the alloy up to a uniform temperature below which it will not recrystallize, and then performing the rolling operation. This rolling operation could be carried out either warm (approximately 200° C.), or hot (approximately 400° C., utilizing very high strain rates), or at temperatures within these limits. Several cross rolling passes using stress relieving treatments between the passes are necessary to keep edge cracking to a minimum. The presence of a large amount of precipitates with a wide distribution is believed to increase the overall matrix strain during the working step and makes the deformation more homogeneous.

After the rolling step, additional heating to recrystallize the worked material is not required. When attempted, this can worsen the superplastic response of the alloy. Rather, the material undergoes continuous recrystallization during subsequent superplastic forming of an actual part. The previouly formed, small Zr precipitates then fulfill their function of providing grain boundary pinning during forming.

These and other objects and features of the invention will be apparent from the following detailed description, taken with reference to the accompanying drawings.

DESCRIPTION OF THE PREFERRED EMBODIMENT

Figure 1:
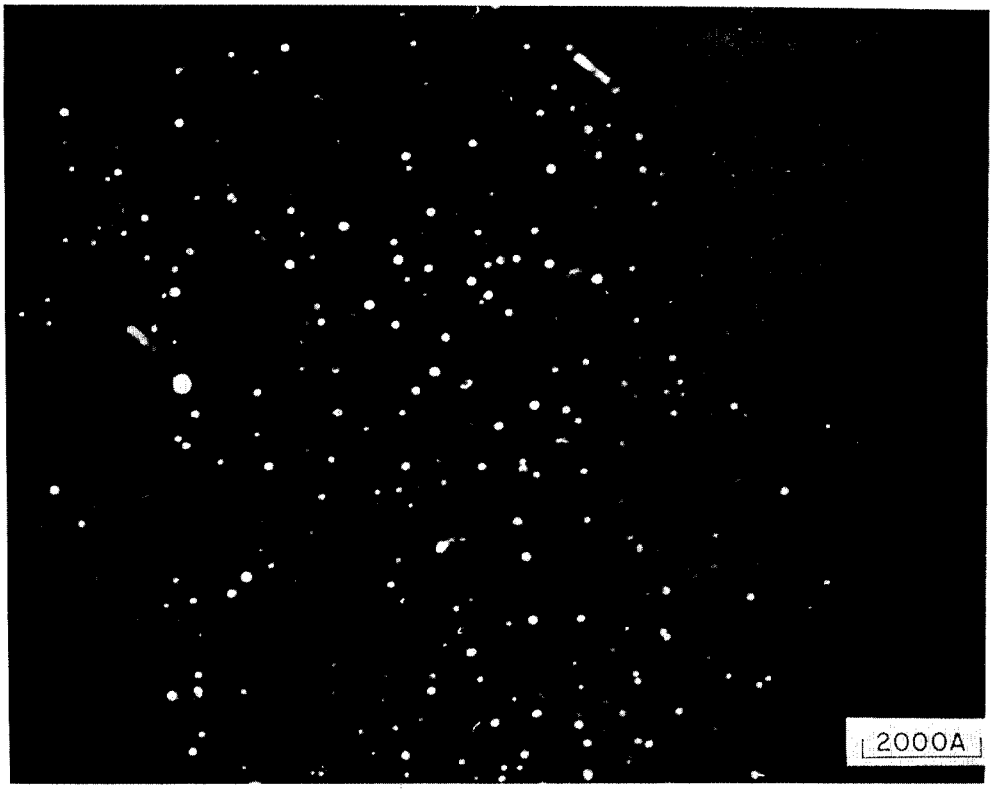
FIG. 1 is a transmission electron micrograph (TEM) showing the very fine Zr-containing dispersoids in the alloy of the invention.

Prior art process, U.S. Pat. No. 4,092,181, has shown that in a precipitation hardenable high strength aluminum alloy coarse precipitates (0.75–4 μm) are developed after overaging of the alloy. In a Zr containing alloy, the dispersoids ($Al_3Zr$) that form are usually very fine (100–300 Angstroms); therefore, these lead to a high particle density as shown in FIG. 1 for the present alloy. Cr-containing dispersoids are coarser (0.1–0.5 μm), and therefore their density is usually lower. If precipitates above a certain critical size are present in an alloy during rolling of the alloy into a sheet, intense plastic deformation can develop around these particles, the extent of which is dependent on the particle size. The aluminum matrix surrounding the $Al_3Zr$ dispersoids is strained due to coherency between the matrix and dispersoids, but no additional strain is generated around them during rolling because of their extremely fine size. On the other hand, due to the coarser size and platelet geometry of the Cr-containing dispersoids, significant additional strain can occur around them over the strain level in the bulk. Yet greater local strain occurs around the large (0.75–4 μm) Cu and Mg aging precipitates that are available in high strength aluminum alloys.

Figure 2:
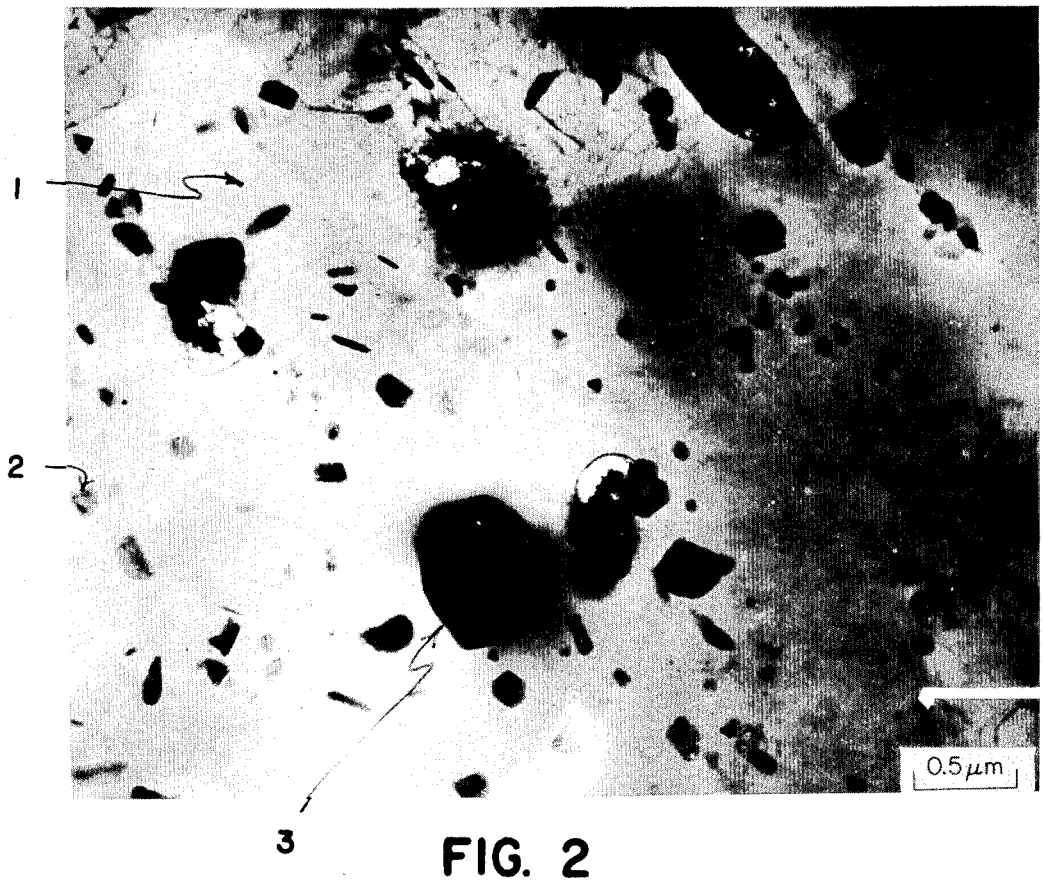
FIG. 2 is a transmission electron micrograph showing the three types of particles in the alloy of the invention.

If Zr and Cr are included in a high strength Al-Zn-Mg-Cu alloy, the resulting alloy can be thermally processed to provide a trimodal particle size distribution as shown in FIG. 2. These particles comprise: (1) very fine (100–300 Angstroms) Zr-containing dispersoids (such as $Al_3Zr$) as shown in FIG. 1 and in area 1 of FIG. 2; (2) intermediate size (0.1–0.5 μm) Cr-containing dispersoids (of complex chemistry) such as shown at 2 in FIG. 2; and (3) coarse (0.75–4 μm) overaged age-hardening-type precipitates such as $CuAl_2$, $MgZn_2$, Cu-Mg-Al, Cu-Zn-Al, and complex precipitates as shown at 3 in FIG. 2. While all these precipitates are present in the same alloy, two separate photographs (FIGS. 1 and 2) are used because different conditions are needed to image the different precipitates in a transmission electron microscope foil. Of these particles, $Al_3Zr$ does not influence internal plastic strain development during rolling, but act as grain boundary pinning agents during subsequent thermal exposure. The presence of the Cr-containing dispersoids between the age-hardening precipitates helps to increase the overall matrix strain during rolling and make deformation more homogeneous throughout. This more homogenous strain coupled with grain boudary pinning effects of $Al_3$ Zr promotes the development of a smaller grain size in the alloy.

Five alloys having compositions within the following ranges were tested: 5.46 to 7.05% Zn, 2.32 to 2.46% Mg, 1.21 to 1.93% Cu, 0.20 to 0.42% Zr, and 0 to 0.3% Cr. It was discovered from these tests and the analysis of the alloys' microstructure that the optimum, nominal composition for use in obtaining a fine grained, superplastic alloy (rounded off to the percentages shown) is: 7% Zn, 2.5% Mg, 2% Cu, 0.3% Zr, 0.3% Cr, and balance aluminum. Because of the high Zr and Cr content of this alloy, it is necessary to use rapidly solidified metal powders rather than more slowly cooled cast ingots in order to produce an alloy with a uniform distribution of dispersoids.

Billets of consolidated powder which are suitable as a starting material for this invention have been procured from the Kaiser Aluminum and Chemical Corporation. Kaiser used its nitrogen gas atomization process to produce the alloy powder by the rapid ($10^{3°}$ to $10^{5°}$ C. $s^{-1}$) solidification of a molten aluminum alloy having the desired chemical composition. Coarse (150 μm) powder and Kaiser's special depurative outgassing method was used to reduce the overall oxide content in the material prior to hot consolidation and extrusion. A low oxide content is desirable to reduce cavitation during superplastic forming.

The powder is loaded into a canister, vacuum degassed, sealed, and hot pressed to consolidate the powder to substantially 100% density. It is then extruded to at least 4:1 reduction. The temperature used during this 8 to 10 hour outgassing, consolidation and extrusion process is in the range of 380° to 400° C. These high temperature processes also cause precipitation of essentially all the precipitating ingredients in the alloy and renders the alloy in a nearly overaged condition. No further precipitation occurs during subsequent working and superplastic forming other than the coarsening of some of the precipitates. The desired trimodal mixture of coarse and fine particles described above with reference to FIG. 2 is thus formed during consolidation and extrusion of the powdered aluminum alloy billet. Additional overaging prior to rolling as taught in prior art fine-grain processes is deliberately avoided to prevent excessive coarsening of these precipitates and a reduction in their density (which is necessary for the development of large homogeneous internal strain).

The as-extruded billet is then mechanically worked by rolling to form sheet. Rolling can be done at any temperature below which the alloy will not recrystallize. However, since rolling at room temperature can lead to severe cracking of the alloy, it may be warm rolled (about 200° C.) or hot rolled (about 400° C.) or rolled at temperatures intermediate between these limites. As a preparation for rolling, the billet is heated to the desired temperature as above and reheated between passes as required to maintain close to this temperature and to stress relieve the billet. The duration of heating and reheating for hot rolling should be kept at a minimum but sufficiently long to assure uniform billet temperature throughout; and, when hot rolled, the billet must be rolled rapidly at a strain rate of about $4\times10^{-1}s^{1}$ minimum in order to introduce the necessary internal work without recrystallization.

The thickness of the material should be reduced approximately 85% or more using cross rolling of alternative passes to develop an isotropic, equiaxed (in-plane) fine-grain structure. In a preferred warm rolling embodiment, the billet is heated to a temperature of 200° C. and reduced approximately 0.050 inches in thickness in each pass. For the duration of initial billet heating, conventional practice is used, i.e., 1 hour for 1 inch thick sections, longer for thicker sections. After each pass, the rolled material is stress relieved at 200° C. for 20 minutes. This heating step provides recovery and stress relief in the alloy, thereby allowing further rolling reduction to be imparted without internal damage or external cracking. In this manner, very large total strain is accumulated.

The thermomechanically processed sheet is now ready for superplastic forming into a part. Additional heat treating prior to forming is not required. In fact, material which was solution treated at 480° C. for 1 to 2 hours after rolling had considerably lower superplastic elongation than the as-rolled material.

In order to determine the subgrain size of the processed alloy prior to superplastic forming, it was solution treated at 482° C. for 30 minutes and aged at 190° C. for 3 hours. This treatment decorates the subgrain and grain boundaries with fine precipitates to reveal structure. The subgrain size obtained for the alloy after processing in accordance wih the invention was less than 1.2 μm, averaging only 0.4 μm.

The high amount of internal strain in the alloy processed according to the invention produces a very fine subgrain structure which is adequately pinned by both Cr- and Zr-containing dispersoids. This stabilizes the fine grain size and minimizes dynamic grain growth during subsequent superplastic forming. Even though this fine grain structure is relatively stable under static annealing conditions grain coarsening can occur and, therefore, forming should be initiated without substantial delay as soon as the sheet material reaches uniform forming temperature to take advantage of the finest microstructure. When superplastically formed between 450° C. and 490° C. at a high strain rate (within $5\times10^{-3}$ per second to $5\times10^{-2}$ per second), the alloy undergoes a continuous dynamic recrystallization and exhibits elongations in the range of 900 to 1400% without needing back pressure to suppress cavitation. Because of its very fine subgrain size, the alloy can be superplastically formed to these high elongations at a strain rate of $2\times10^{-2}$ per second, a rate which is 100 times faster than what is achievable for prior art high strength aluminum alloys, e.g. 7475 alloy. To our knowledge, this kind of high superplastic elongation has not been previously possible at such high forming rates for an aluminum alloy having yield strength in excess of 80 ksi.

Figure 3:
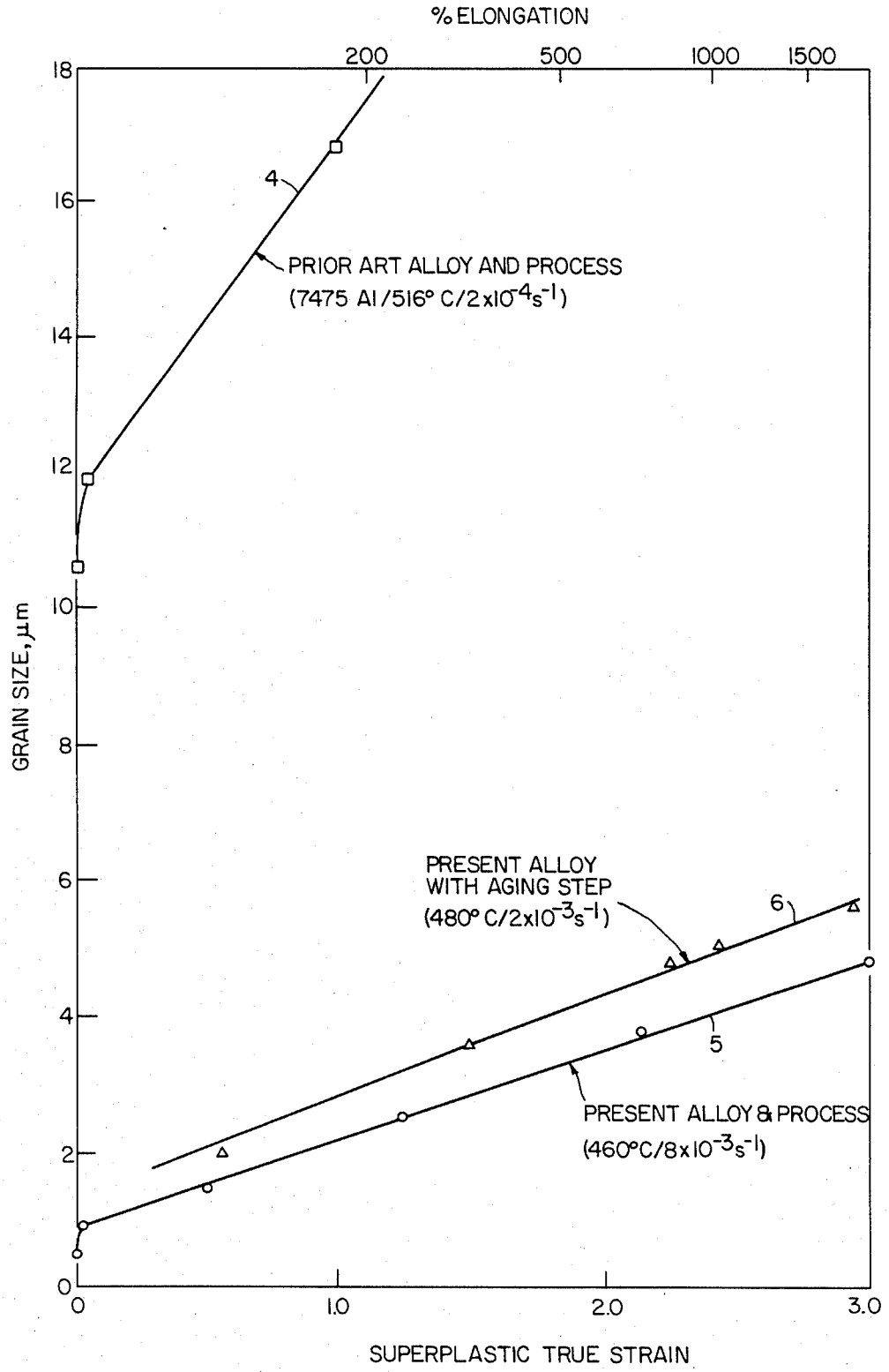
FIG. 3 is a plot of superplastic strain vs average grain size after superplastic forming for the alloy of the invention processed according to the invention and for a prior art alloy processed according to the prior art. The superplastic forming temperature and strain rate are shown in parenthesis.

Not only is this alloy capable of developing a fine initial subgrain size, but it is capable of maintaining a finer grain size during deformation. FIG. 3 shows the grain size after superplastic forming for a prior art alloy and process (curve 4) compared to an alloy and process (curve 5), according to the invention. The grain size remains relatively small even after extensive superplastic strain. Also shown (curve 6) is the effect of aging the rolled sheet at 400° C. for 1 hour on grain growth during forming. Presumably aging causes an acceleration of grain growth during superplastic forming and a poorer tensile elongation. This grain stability of the preferred alloy is attributed to Zener pinning effect from a large number of dispersoids. While this latter effect could be achieved by using a higher weight percent of Zr in the alloy by itself, this approach does not produce as fine a starting microstructure. Thus, it is the combined effect of intermediate and finer particles (containing Cr and Zr respectively) that is needed. An additional item to note is the need for a uniform distribution of these particles in the alloy to obtain a uniformly fine grain size. This is easily achieved by the rapid solidification process utilized in this work. When conventional ingot casting approaches are used, an alloy of a similar chemistry has been found to generate coarse intermetallics and poor distribution of dispersoids, leading to coarser grain size and substantially inferior superplastic properties.

By virtue of the fine subgrain (and grain) size (0.4–1.2 μm), this alloy is also able to maintain a lower flow stress during superplastic forming (450–600 psi at 460° C. at $5\times10^{-3}$ per second). This leads to reduced cavitation problems as well. After forming, the alloy may be heat treated similarly to conventional 7000 series aluminum alloys to the T6 condition by solution treating and aging. The room temperature yield strength of this alloy after superplastic forming is about 82 KSI in the T6 condition.

Based upon the alloy compositions tested as described above, the optimum nominal composition selected, and the tolerance range that is generally accepted for high strength aluminum alloys, the following chemical compositon range has been determined for the alloy according to the invention: 6.0 to 8.0% Zn, 1.5 to 3.5% Mg, 1.0 to 3.0% Cu, 0.2 to 0.4% Zr, 0.2 to 0.5% Cr and the balance aluminum and minor amounts of impurities, with Fe and Si content being less than 0.05% each.

Numerous variations can be made without departing from the invention. Accordingly, it should be understood that the form of the invention described above is illustrative and is not intended to limit the scope of the invention.

What is claimed is:

1. A method of producing a high forming rate, high strength superplastic aluminum base alloy comprising the steps of:

providing a powdered aluminum base alloy consisting essentially of 6.0 to 8.0 % Zn, 1.5 to 3.5% Mg, 1.0 to 3.0 % Cu, 0.2 to 0.4 % Zr, and 0.2 to 0.5 % Cr, the powder being produced by rapid solidification of the aluminum base alloy in an inert atmosphere;

consolidating said powder alloy by thorough outgassing, hot pressing and extrusion at a 4:1 minimum reduction at about 380° C. to 400° C., with approximately 8–10 hours of exposure to this temperature;

heating the aluminum base alloy to a uniform rolling temperature which is low enough to avoid recrystallization but high enough to prevent cracking, and rolling at that temperature utilizing cross rolling passes to reduce its thickness about 85% and to provide a sheet of the aluminum base alloy having a subgrain size less than 1.2 μm;

heating the sheet of aluminum base alloy to a superplastic forming temperature in a range from 450° C. to 490° C.; and superplastically forming the sheet of aluminum base alloy without substantial delay after reaching the forming temperature at a strain rate in a range of $5\times10^{-3}$ to $5\times10^{-2}$ per second to obtain maximum elongation.

2. The method as claimed in claim 1 wherein the rolling is done at about 200° C. and wherein the aluminum base alloy is stress relieved at 200° C. between passes as required to prevent internal damage and external cracking of the alloy.

3. The method as claimed in claim 1 wherein the rolling is done within the temperature range of 200° C. to 400° C.

4. The method as claimed in claim 1 wherein the superplastic forming comprises forming at least portions of the sheet to elongations of over 900%.

5. The method as claimed in claim 3 wherein a high strain rate of about $4\times10^{-1}S^{-1}$ is utilized when rolling at 400° C.

* * * * *